US010960288B2

(12) United States Patent
Armstrong et al.

(10) Patent No.: US 10,960,288 B2
(45) Date of Patent: Mar. 30, 2021

(54) HANDHELD ARTICLE CARRIER

(71) Applicant: XcelTek LLC, Conroe, TX (US)

(72) Inventors: Keith L. Armstrong, Conroe, TX (US); Phillip Lawson, Conroe, TX (US); Lee L. Reneau, Conroe, TX (US)

(73) Assignee: XcelTek LLC, Conroe, TX (US)

( * ) Notice: Subject to any disclaimer, the term of this patent is extended or adjusted under 35 U.S.C. 154(b) by 229 days.

(21) Appl. No.: 16/180,682

(22) Filed: Nov. 5, 2018

(65) Prior Publication Data

US 2019/0070480 A1 Mar. 7, 2019

(51) Int. Cl.

| | |
|---|---|
| ***A63B 71/00*** | (2006.01) |
| ***A45F 5/10*** | (2006.01) |
| ***A45F 5/00*** | (2006.01) |
| *A63B 21/072* | (2006.01) |

(52) U.S. Cl.

CPC ..... *A63B 71/0036* (2013.01); *A45F 5/00* (2013.01); *A45F 5/10* (2013.01); *A45F 5/102* (2013.01); *A45F 2005/1086* (2013.01); *A45F 2200/0583* (2013.01); *A63B 21/0726* (2013.01); *A63B 2225/682* (2013.01); *A63B 2225/685* (2013.01); *A63B 2225/687* (2013.01)

(58) Field of Classification Search

CPC ... A63B 71/0036; A63B 21/0726; A45F 5/00; A45F 5/10; A45F 5/102; A45F 2005/1086

USPC ..... 294/146

See application file for complete search history.

(56) References Cited

U.S. PATENT DOCUMENTS

| | | | | | |
|---|---|---|---|---|---|
| 3,923,278 | A * | 12/1975 | Marcil | A47G 1/20 | 248/301 |
| 4,666,038 | A * | 5/1987 | Minneman | A63B 55/10 | 206/315.2 |
| 4,993,770 | A * | 2/1991 | Groves | A63B 21/0724 | 206/303 |
| 5,630,776 | A * | 5/1997 | Yang | A63B 71/0036 | 482/104 |
| 6,032,999 | A * | 3/2000 | York | A63B 55/10 | 294/143 |
| D424,141 | S * | 5/2000 | Eckmann | D21/686 | |
| 7,134,548 | B2 * | 11/2006 | Meehan | A45C 11/00 | 206/315.1 |
| 9,731,161 | B2 * | 8/2017 | Meeker | A63B 21/0726 | |
| 10,610,760 | B2 * | 4/2020 | Nowlan | A63B 71/0036 | |
| 2014/0367351 | A1 * | 12/2014 | Juen | A63B 21/0726 | 211/85.7 |
| 2017/0127814 | A1 | 5/2017 | Mundy | | |

* cited by examiner

*Primary Examiner* — Dean J Kramer
(74) *Attorney, Agent, or Firm* — Tumey L.L.P.

(57) ABSTRACT

A handheld article carrier is designed to accommodate dumbbells and other personal items such as water bottles, cellphone, keys etc. The carrier may be formed from a single piece of sheet metal material and is generally U-shaped. The carrier includes sidewalls each having a slot for supporting the shaft portion of one or more dumbbells. The carrier includes a handle that may be integrally formed in a central portion of the frame of the carrier, or attached as a separate piece. The article carrier can be made from a single sheet of metal, multiple sheets of metal, a combination of metal and natural materials, all natural materials, a combination of metal and synthetic materials, or all synthetic materials.

4 Claims, 4 Drawing Sheets

HANDHELD ARTICLE CARRIER

BACKGROUND OF THE INVENTION

Field of the Invention

This invention relates to a handheld article carrier for transporting diverse articles from one location to another. It is particularly adapted to hand carry dumbbells and personal items such as keys, cellphones, drinks, wallets etc. from one location to another in a secured manner.

Background of the Invention

Known devices for transporting articles such as dumbbells do not provide a stable support and do not accommodate carrying several different items. See for example US2017/0127814.

BRIEF SUMMARY OF SOME OF THE PREFERRED EMBODIMENTS

The present invention is directed to a relatively rigid article carrier that is designed to accommodate dumbbells and other personal items. The carrier may be formulated from a single piece of sheet metal. The carrier is also designed to be able to gather and lift dumbbells off a support surface such as the floor in a scoop like manner.

The carrier provides the ability to transfer dumbbells and other personal items in a secured and stable fashion.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
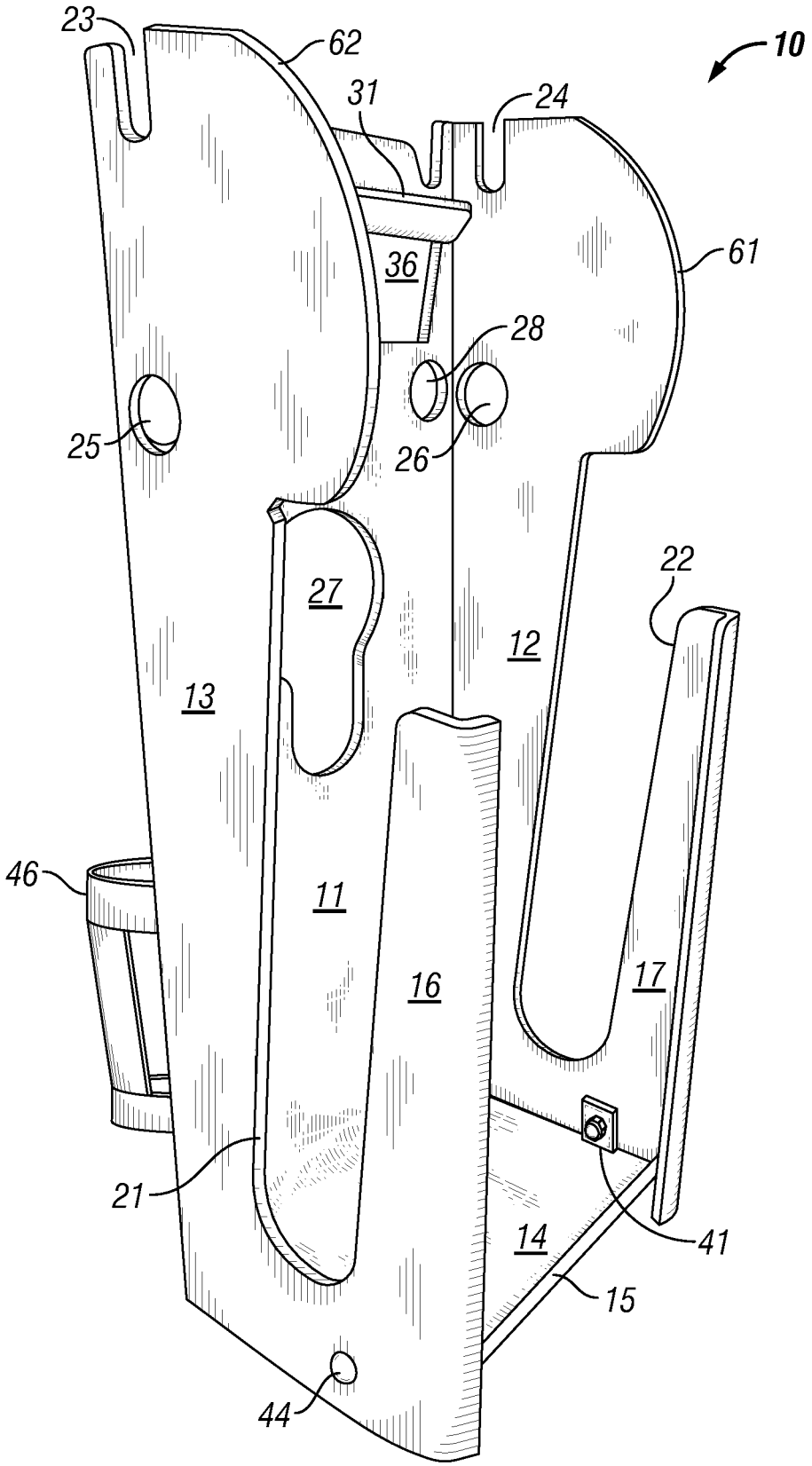
FIG. 1 illustrates a perspective view of an embodiment of the invention.

As shown in FIG. 1 an article carrier 10 according to an embodiment of the invention includes a frame which includes a central portion 11, and two side walls 12 and 13 which extend outwardly from an opposite side of central portion 11. The frame also includes a bottom portion 14 having a pair of upstanding tabs 41 that can use used to secure the bottom portion 14 to side portions 12 and 13 by a bolt and nut assembly 43, 44. Bottom portion 14 includes an upwardly extending lip 15.

Figure 4:
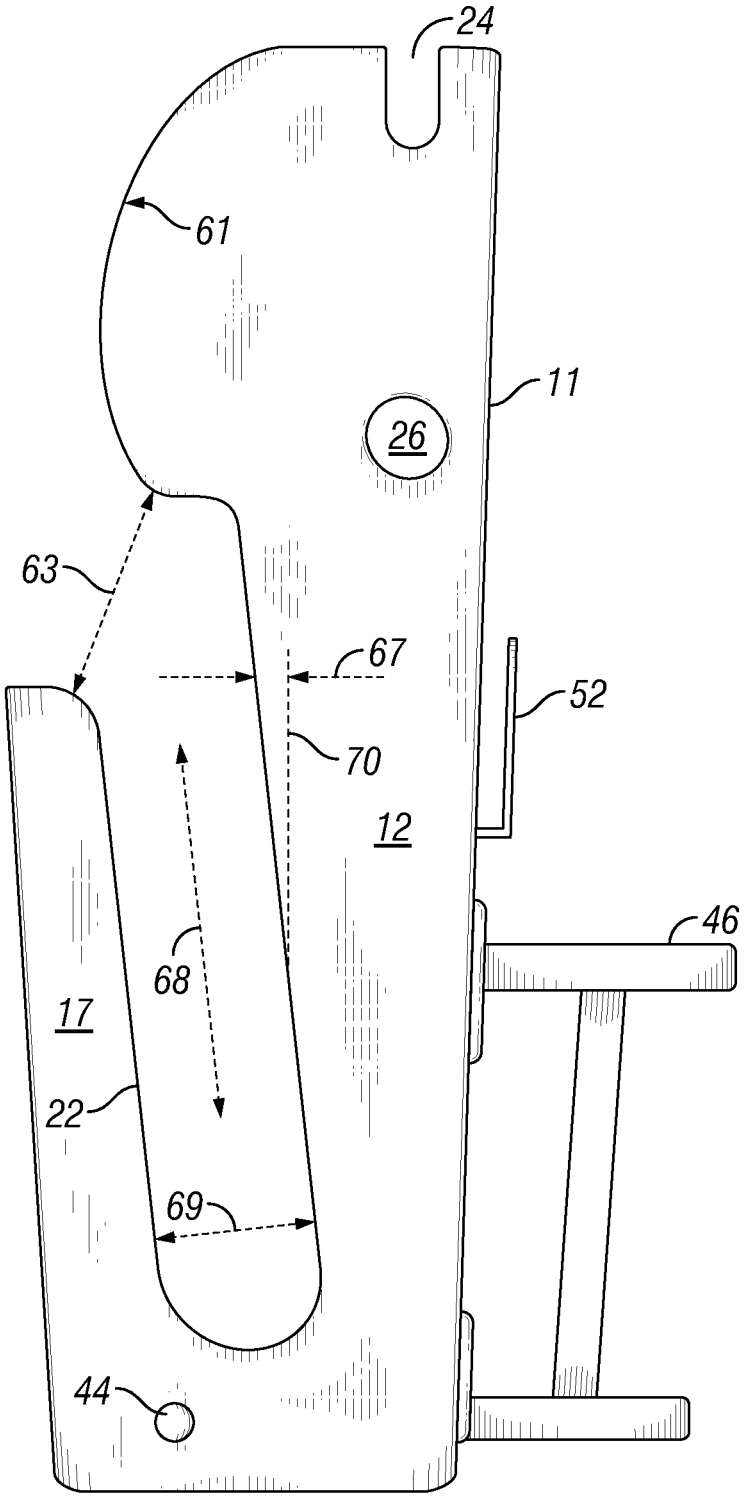
FIG. 4 illustrates a side elevation view of an embodiment of the invention.

As shown in FIGS. 1 and 4, side walls 12 and 13 include inclined cutout slots 21 and 22 that have an inclined longitudinal axis 68 which is slightly inclined with respect to a longitudinal axis 70 of the carrier at an angle 67. Angle 67 may be in the range of two to ten degrees for example.

Figure 2:
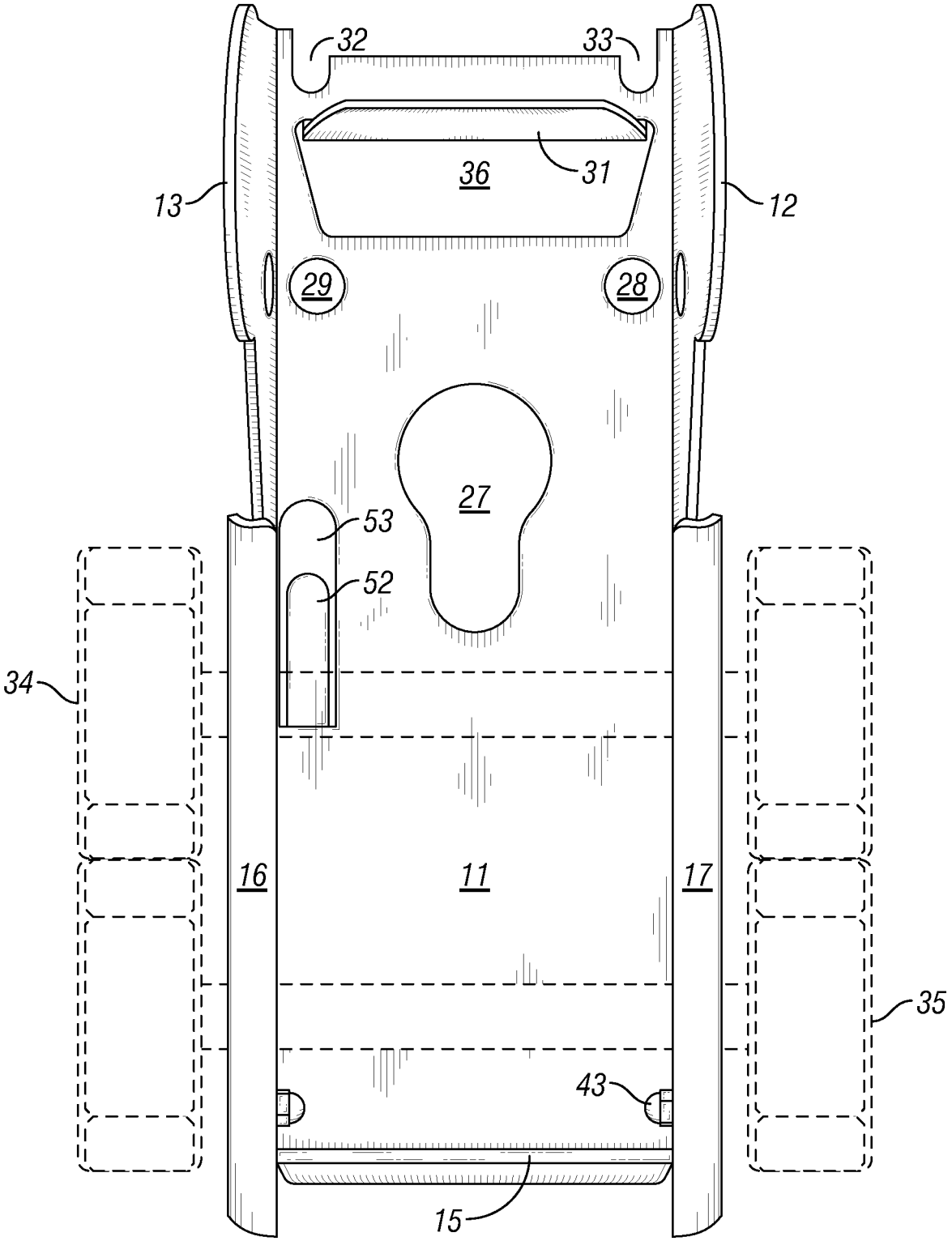
FIG. 2 illustrates a front elevation of an embodiment of the invention.

The width 69 of slots 21 and 22 is chosen to accommodate the shaft of popular sized dumbbells 34, 35 shown in phantom in FIG. 2. Side walls 13 and 12 include L shaped front portions 16 and 17 as shown in FIGS. 1 and 2.

Central portion 11 of the frame include a key hole slot 27 for supporting any object with a stem and circular member such as pop socket knobs currently attached to the rear of cell phones.

Figure 3:
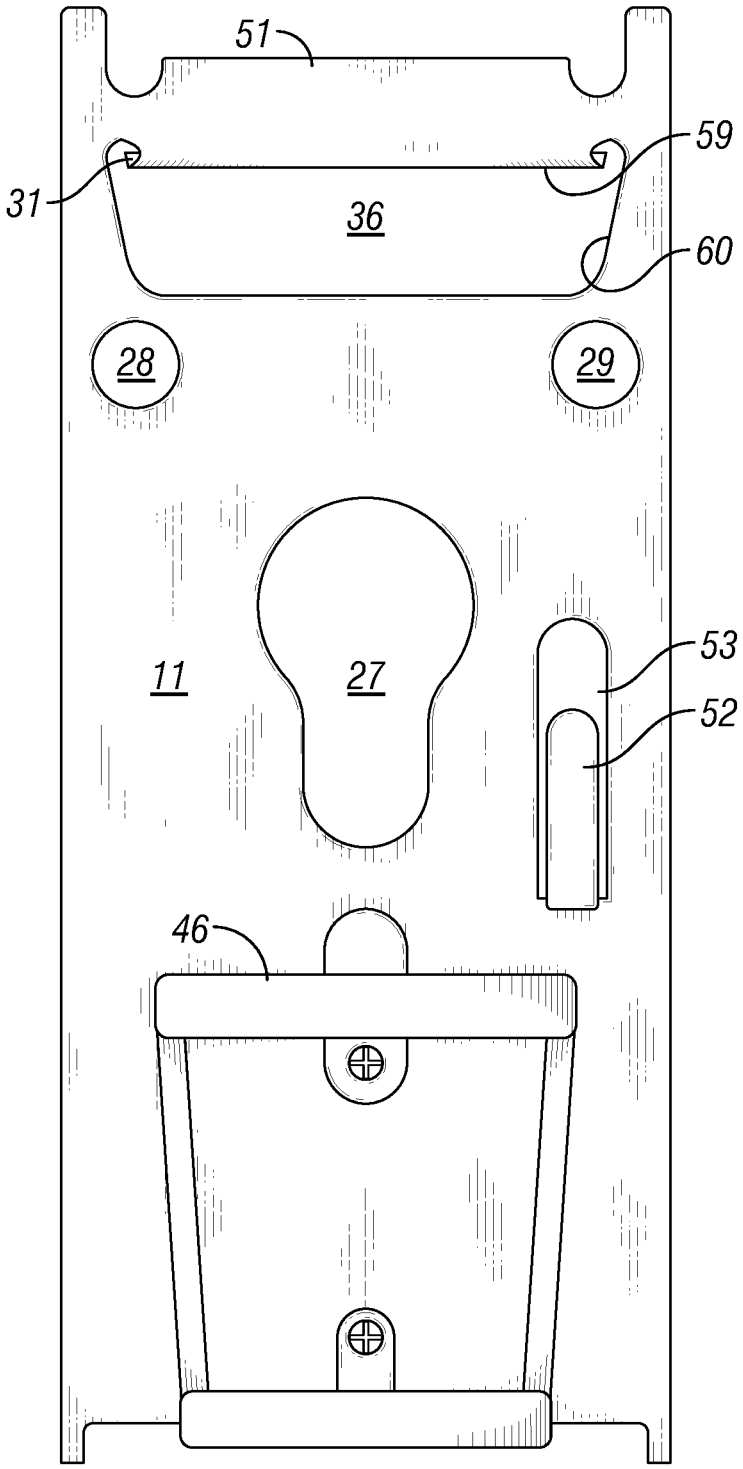
FIG. 3 illustrates a rear elevation view of an embodiment of the invention.

Central portion also includes a curved integral handle 31 which is formed by a three sided slot 60 in the sheet metal and then bending portion 31 upward along a line 59 as shown in FIG. 3. This forms a cross piece 51 and opening 36 which together with bent portion 31 forms a handle for carrying the article carrier. Central portion also includes openings 25, 26, 28, 29, and notches 23, 24, 32, 33 for attaching personal items such as keys etc. to the carriers. An additional cutout 53 with a tongue 52 may be formed in the back of central portion as shown in FIGS. 3 and 4. Also a cup or bottle holder 46 may be secured to the back of the central portion 11.

Another feature of the invention is that the geometry of the side walls 12, 13 and the slots 21 and 22 is selected so that the carrier may be used to pick up dumbbells that are on a longital surface such as a floor in a scoop like manner. Specifically sides 11 and 12 have a curved section 61, 62 which extend to a mouth area 63 of the slots as shown in FIG. 4. Dumbbells may be scooped up by grasping handle 31 and positioning mouth portion 63 adjacent to the shaft of the dumbbell. The rounded portion of the sidewalls at the mouth portion will guide the shafts of the dumbbells into slots 21 and 22 as the carrier is moved approximately parallel to the horizontal surface that is supporting one or more dumbbells. Once the shafts of the dumbbells are located within the slots, the carrier can be rotated approximately ninety degrees to an upright position with the dumbbells supported within the frame.

The Article Carrier is designed to retain the dumbbells when the carrier is laying on its back without the water bottle holder or on its face with or without the water bottle carrier. The Article Carrier keeps the dumbbells from rolling around in a vehicle while driving by keeping them contained within the Article Carrier. Curved sections 61 and 62 contain the dumbbell in the slot.

The carrier can be made from single sheet of metal, multiple sheets of metal, a combination of metal and natural materials, all natural materials, a combination of metal and synthetic materials, or all synthetic materials.

Although the present invention and its advantages have been described in detail, it should be understood that various changes, substitutions and alterations may be made herein without departing from the spirit and scope of the invention as defined by the appended claims.

What is claimed is:

1. A handheld article carrier comprising:

a. a frame including a central portion and two sidewall portions;

b. each sidewall including a vertically extending slot being open at an upper portion thereof;

c. the central portion and the sidewalls forming a structure having a general U-shape; and d. a handle;

wherein the frame further includes a bottom; and wherein the bottom includes an upwardly extending lip.

2. A handheld article carrier comprising:

a. a frame including a central portion and two sidewall portions;

b. each sidewall including a vertically extending slot being open at an upper portion thereof;

c. the central portion and the sidewalls forming a structure having a general U-shape; and d. a handle;

further including a cup holder attached to a backside of the central portion of the frame.

3. A handheld article carrier comprising:

a. a frame including a central portion and two sidewall portions;

b. each sidewall including a vertically extending slot being open at an upper portion thereof;

c. the central portion and the sidewalls forming a structure having a general U-shape; and d. a handle;

wherein the handle is formed by cutting through the central portion of the frame and bending up a resultant flap formed by cutting through the central portion.

4. A handheld article carrier comprising:

a. a frame including a central portion and two sidewall portions;

b. each sidewall including a vertically extending slot being open at an upper portion thereof;

c. the central portion and the sidewalls forming a structure having a general U-shape; and d. a handle;

wherein the central frame portion includes a cutout and a tongue extending outwardly from the cutout.

* * * * *